US005279930A

United States Patent [19]

Green et al.

[11] Patent Number: 5,279,930

[45] Date of Patent: Jan. 18, 1994

[54] REPLENISHMENT SYSTEMS

[75] Inventors: Andrew Green, Harrow; Susan Carter, Chorleywood; Peter J. Twist, Missenden, all of United Kingdom

[73] Assignee: Eastman Kodak Company, Rochester, N.Y.

[21] Appl. No.: 852,230

[22] PCT Filed: Nov. 28, 1990

[86] PCT No.: PCT/EP90/02038

§ 371 Date: May 29, 1992

§ 102(e) Date: May 29, 1992

[87] PCT Pub. No.: WO91/08514

PCT Pub. Date: Jun. 13, 1991

[30] Foreign Application Priority Data

Nov. 30, 1989 [GB] United Kingdom ..... 8927099

[51] Int. Cl.[5] ..... G03C 5/31; G03C 5/395

[52] U.S. Cl. ..... 430/398; 430/399; 430/400

[58] Field of Search ..... 430/398, 399, 400

[56] References Cited

U.S. PATENT DOCUMENTS

| | | | |
|---|---|---|---|
| 4,228,234 | 10/1980 | Okutsu et al. | 430/399 |
| 4,245,034 | 1/1981 | Libicky et al. | 430/399 |
| 4,245,043 | 1/1981 | Lund | 435/33 |
| 4,293,211 | 10/1981 | Kaufmann | 354/321 |
| 4,295,729 | 10/1981 | Kaufmann | 354/324 |
| 4,329,042 | 5/1982 | Libicky et al. | 354/324 |
| 4,346,981 | 8/1982 | Kaufmann | 354/324 |
| 4,372,665 | 2/1983 | Kaufmann | 354/297 |
| 4,372,666 | 2/1983 | Kaufmann | 354/297 |

FOREIGN PATENT DOCUMENTS

| | | |
|---|---|---|
| 57-195245 | 11/1982 | Japan . |
| 57-195246 | 11/1982 | Japan . |
| 57-195247 | 11/1982 | Japan . |

*Primary Examiner*—Charles L. Bowers, Jr.
*Assistant Examiner*—Mark F. Huff
*Attorney, Agent, or Firm*—Sarah M. Roberts

[57] ABSTRACT

It is known to replenish processing solutions in photographic processing apparatus in accordance with the throughput of material being processed. However, in low usage apparatus, there is no allowance for other losses which may occur, for example due to evaporation and/or oxidation. Described herein is a method of replenishing such processing solutions which allows for losses due to evaporation and/or oxidation. The method comprises determining a relationship between loss rates due to evaporation and/or oxidation, and water evaporation rate from the apparatus. It has been found that the relationship is substantially linear.

6 Claims, 4 Drawing Sheets

REPLENISHMENT SYSTEMS

The present invention relates to replenishment systems and is more particularly concerned with the replenishment of photographic processing solutions in photographic processing apparatus.

Developers, and other solutions, used for photographic processing, suffer from depletion fog two principal reasons. The first is that components involved in the photographic process are used up as sensitized material is passed through the solution, while the second depends on losses which occur without any processing taking place. The latter may be due, for instance, to aerial oxidation, evaporation, or an interaction between components in the processing solution itself.

In a continuous photographic process, it is good practice to replenish solutions, by replacing a proportion of the original solution with another which has been formulated to replace those components which have been lost while reducing the level of unwanted by-products of the process.

Replenishment is normally carried out by adding a specially formulated solution to the bulk tank. This displaces a similar quantity of the used solution, at a rate which is calculated on the basis of the amount of material which has been processed. The assumption is made that other losses may be roughly accounted for at the same time.

For processes which have a low relative rate of usage, however, such an assumption is scarcely valid, and those losses which are independent of material throughput become very important. This means that adequate replacement must be provided separately.

One solution to the problem has been to use a second replenisher delivered at a rate which is proportional to elapsed time. Such systems are disclosed in Japanese Patent Specifications 57-195245, 57-195246, 57-195247, and U.S. Pat. Nos. 4,228,234, 4,245,043, 4,293,211, 4,295,729, 4,329,042, 4,346,981, 4,372,665, and 4,372,666.

In U.S. Pat. Nos. 4,293,211, 4,295,729, 4,346,981, 4,372,665 and 4,372,666, replenishment of anti-oxidants is disclosed. In particular, replenishment is carried out at two rates, a first rate which compensates for use of the processing apparatus, and a second lower rate which compensates for non-use of the apparatus. However, in each case, the replenishment is a function of expired time and is related to the particular apparatus used.

In U.S. Pat. Nos. 4,245,043 and 4,329,042, the use of two replenishers and water is disclosed. The replenishers are added to the processing apparatus at one rate in accordance with the throughput of material being processed. The same replenishers are used to replenish at a second rate to compensate for non-use of the apparatus.

U.S. Pat. No. 4,228,234, describes a time-dependent replenishment system in which the rate of replenishment is dependent on time, ambient temperature and a constant which is related to the specific apparatus being replenished. This means that before being able to use the disclosed system for other apparatus, the constant has to be determined through experiment.

Furthermore, the systems described above do not accurately allow for differences in temperature between start-up conditions and operating conditions.

It is therefore an object of the present invention to provide a replenishment system which allows for the replenishment of solutions used in processing apparatus which suffer losses due to evaporation or oxidation, and which overcomes the problems associated with known replenishment systems.

According to one aspect of the present invention, there is provided a method of replenishing photographic processing solutions in photographic processing apparatus in which one or more components are lost from the processing solution by oxidation or evaporation, characterized in that the replenishment rate for a particular component in a given solution is determined as a function of water evaporation rate from the apparatus.

Advantageously, the function for any given solution is determined by measuring component loss rates for that solution for different water evaporation rates.

By this method, once the loss rate for a particular component in a solution has been determined, this rate can be applied to any processing apparatus using the same solution.

The present invention will now be described, by way of example only, with reference to the accompanying drawings, in which.

Figure 1:
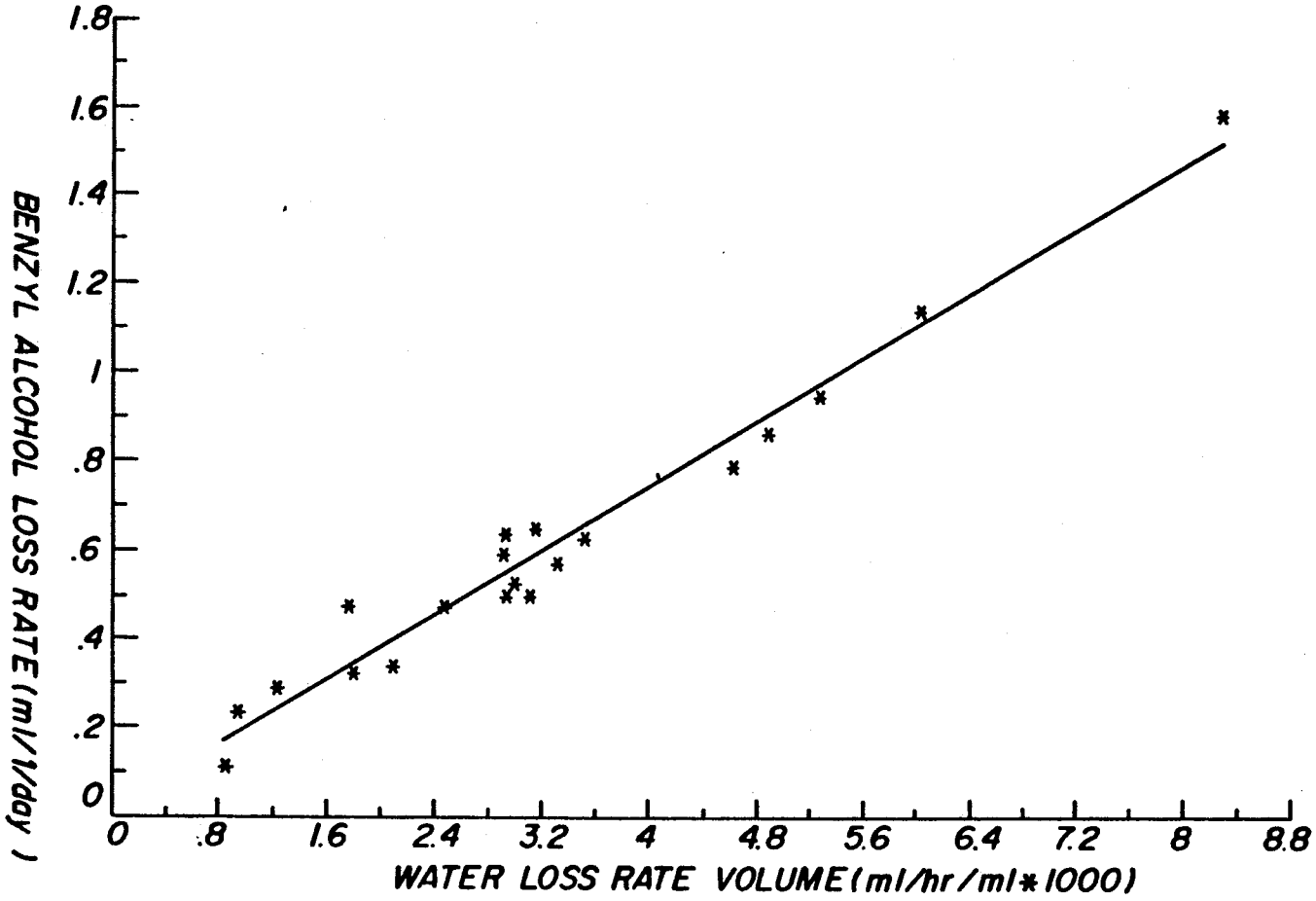
FIG. 1 shows the relation between benzyl alcohol loss rate and water evaporation rate.

Chemical loss rates were measured in a variety of processing machines of different types and having different developer tank volumes. Chemical loss rates were also measured in laboratory standing tests. In these standing tests, containers having a volume of 1l with a range of surface/volume ratios were used. The chemical loss rates can be determined by using an 'effective surface/volume' ratio.

Since the relative humidity, the air-space, the airflow, and the solution surface agitation vary in the tests mentioned above, the geometrical surface/volume ratio is not adequate to estimate oxidative or evaporative loss rates of volatile components.

The 'effective surface/volume' ratio will be generally higher than the geometrical surface/volume ratio and can be estimated by measuring the water evaporation rate/volume ratio, that is, the effective surface/volume is directly proportional to the water evaporation rate/volume.

The efficiency of this ratio can be tested by plotting the oxidative and evaporative loss rates against water evaporation rate/volume ratio. In addition, the effect of temperature change can be accounted for in the same way since loss rates and evaporation rates change in the same direction with temperature.

The rate of addition of time dependent replenisher (TDR) to a particular processing machine depends on the loss rates of the various components. It is possible by measuring loss rates as a function of time and the amount of sensitized material which is processed to construct a computer model of a particular process in a particular machine. It is possible from this model to predict the composition and rate of addition of the TDR to be used. Unfortunately, there are many different types of processor in use and it would be difficult to model all these. However, five different types have been modelled and the rates of TDR addition calculated.

It can be seen in Table 1 from the relation between the machine tank volume (V) and the TDR rate (R) that the ratio R/V is approximately constant for five different machines.

TABLE 1

| Machine | Tank volume and TDR rate V (l) | R (ml/hr) | R/V |
|---|---|---|---|
| 1 | 44 | 61 | 1.39 |
| 2 | 70 | 104.3 | 1.49 |
| 3 | 660 | 964 | 1.46 |
| 4 | 40 | 64.3 | 1.60 |
| 5 | 40 | 60.3 | 1.51 |

The mean value of R/V is 1.49 with a standard deviation of 0.076. This means that to a first approximation the rate of TDR addition (ml/hr) can be calculated from the processor developer-tank volume in litres multiplied by 1.49.

The reason for this simple relation is that the total surface to volume ratio of these five machines is similar and so the loss rates per unit volume are similar. Consequently the larger the volume the greater the addition rate.

If processing machines have very different surface to volume ratios then the simple relation in Table 1 might not hold. In addition the meaning of surface to volume ratio is complex if absorbent rollers are continually turning and exposing fresh solution surface to the air.

One way to estimate a 'true surface to volume ratio' is to use the water evaporation rate which should be related to the geometrical surface to volume ratio plus the effects of rollers and surface agitation.

It was found that this worked well and small bench top expertments with 300 ml to 11 of solution gave similar results to large processing machines. This also worked for processing solutions at different temperatures.

FIG. 1 shows the relation between benzyl alcohol loss and water evaporation rate/volume for a variety of developer formulae, surface/volume ratios, and temperatures. The correlation coefficient is 0.968. The data is derived from laboratory standing tests and commercial processing machines. The relation is linear and passes through the origin.

Consequently, the water loss rate divided by the developer tank volume can be used to estimate the chemical and evaporative loss rates in a processing machine for which no loss data is available, or which is being run at a different temperature, or both.

Figure 2:
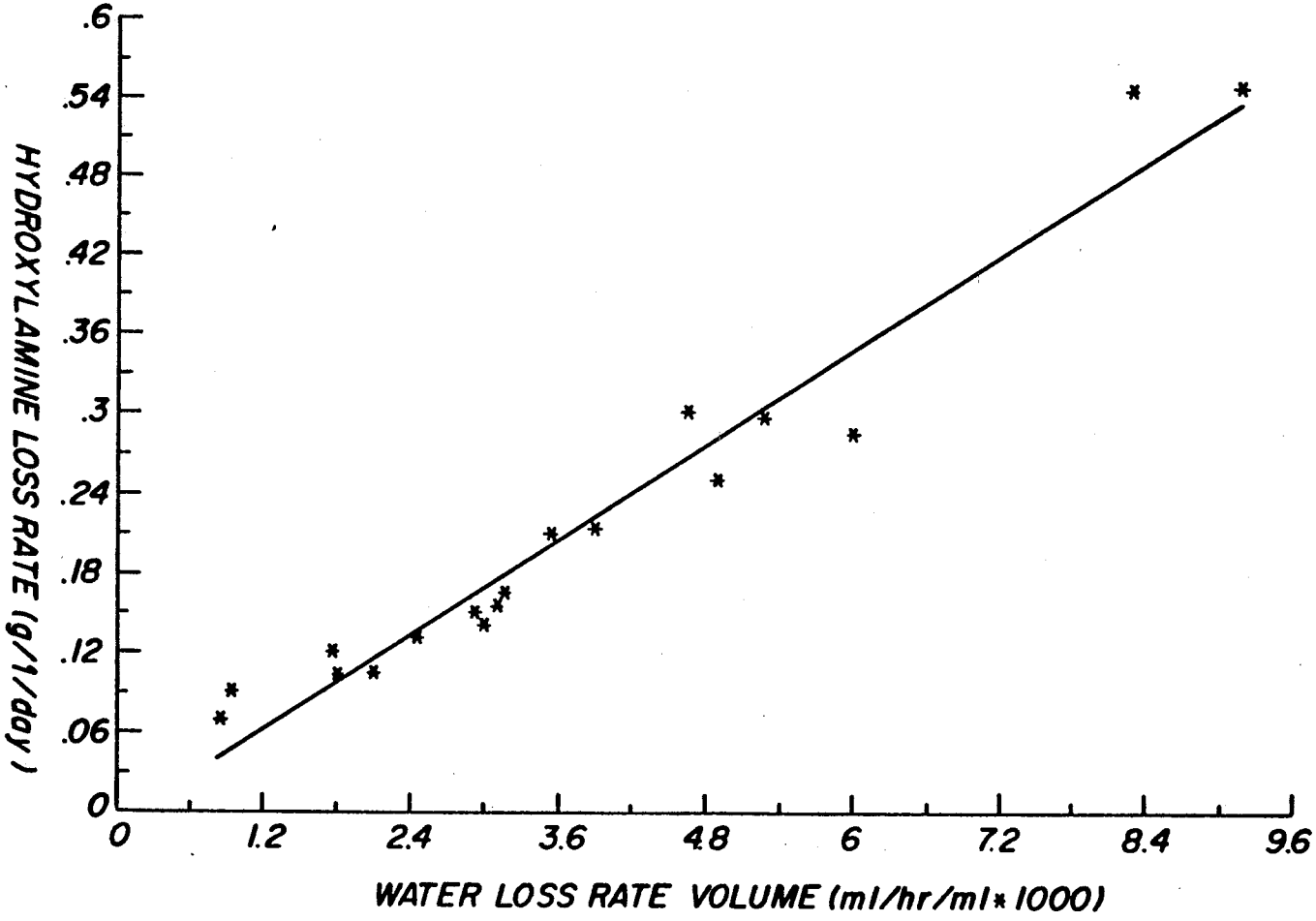
FIG. 2 shows the relation between hydroxylamine loss rate and water evaporation rate.
Figure 3:
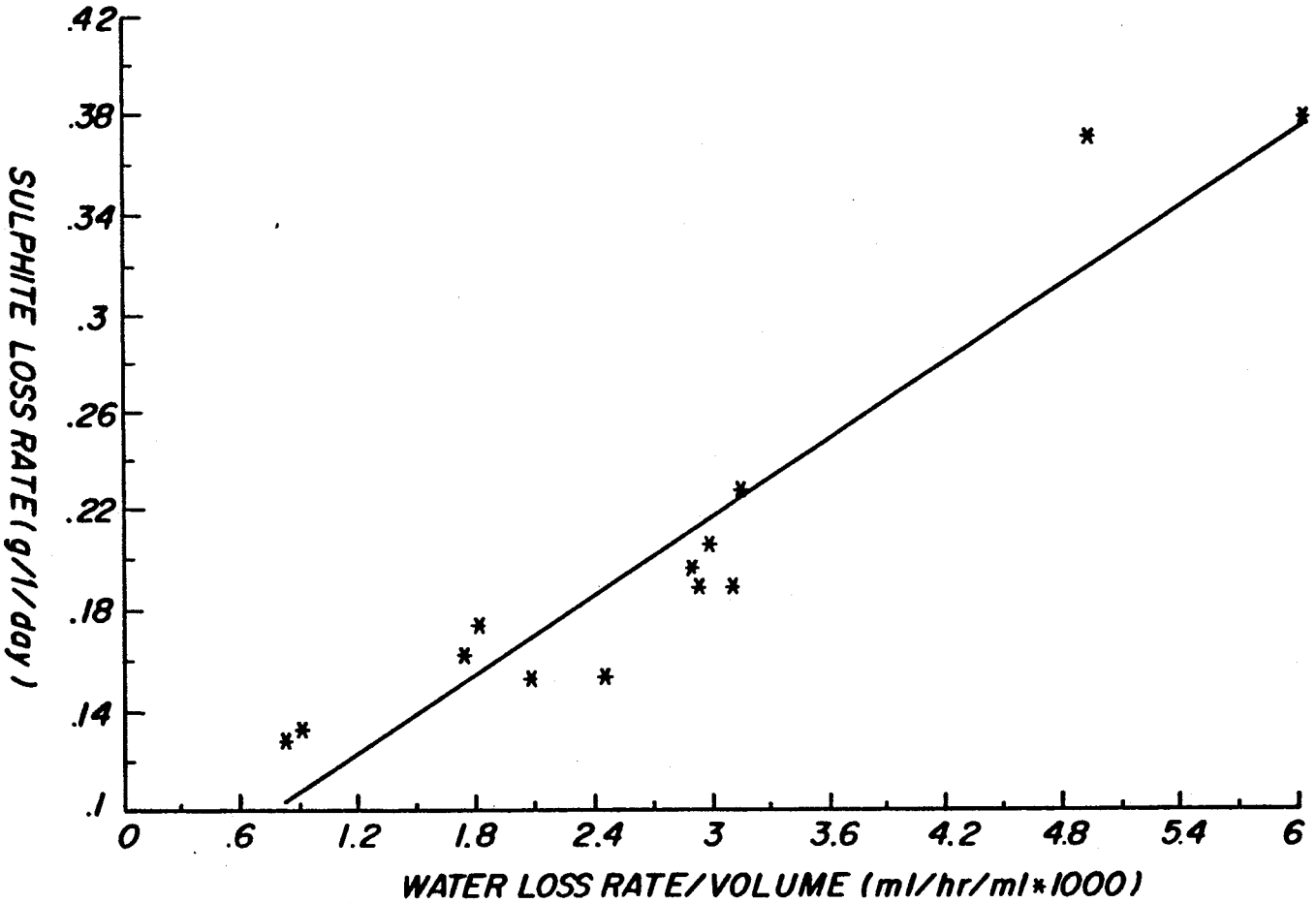
FIG. 3 shows the relation between sulphate loss rate and water evaporation rate.

In FIGS. 2 and 3 similar relationships are shown for hydroxylamine loss and sulphite loss respectively. These do not correlate quite as well as benzyl alcohol because there is some anaerobic reaction with hydroxylamine and sulphate which does not depend on surface area.

In addition, these two components are lost by chemical reactions which can be catalysed by traces of heavy metal ions such as iron and copper and these ions might, in practice, be present in variable amounts due to variations in water-and chemical sources. This means that the plots of chemical loss rate against water loss rate are probably not straight lines but some more complex function and also have intercepts indicating some chemical loss even at zero water loss. This is probably true for FIGS. 2 and 3 even though straight lines are shown.

In the case of benzyl alcohol the loss is almost solely by evaporation and therefore a better correlation would be expected.

In spite of these imperfections it is possible to estimate the loss rate of a volatile component or one which is lost by oxidation for an unknown machine simply by measuring its evaporation rate in ml/hr and the tank volume. This constitutes one of the main novel features of this invention. Evaporation rate must be measured under realistic conditions, that is, as the processor would normally be run with lids in place and up to temperature.

Similar relationships exist for the other components of photographic processing solutions, and, coupled with the knowledge of the tank volume and measurement of the water evaporation rate, these relationships can be used to calculate replenishment rates in an otherwise unknown system.

Ultimately it is desirable to control each component of the process individually. This would require a control unit capable of calculating the absolute rates of loss for each component, and a dispenser—operated by that controller—which would add components as powders, liquids, or as concentrates, and dissolve or disperse them in situ.

For any particular sensitized material the rate of loss of components caused by the processing of the material is essentially proportional only to the area of materials used—and over the normal range of processing conditions both the solution temperature and the machine configuration can be disregarded. Thus, for any particular material, a replenisher can be formulated to be applied at a predetermined rate proportional to the area throughput.

In order to maintain solution concentrations accurately, it is important to consider the matter of topping-up a tank with water to replace that which has evaporated. In general, any replenisher could be formulated with only those components which must be replaced—in which case it must be added to the tank before topping-up—or it could be formulated with those same components in addition to the preferred tank starting formula—in which case it should be added after topping-up, so that used solution is displaced.

The losses due to evaporation and oxidation are dependent on time and so are ideally made good by addition of TDR. The losses of chemical components due to usage by the sensitized material also need to be known if a complete model of the replenishment system is to be made. These losses depend primarily on the nature of the sensitized material and not significantly on the type of processing machine. Thus, once these are known, the procedure outlined in this specification can be used to estimate the evaporative and oxidative losses and a complete chemical loss assessment can be made for a processor on which there was no experience of running the formula.

There are three main ways in which the TDR principle can be applied in practice as outlined in cases 1 to 3 below:

Case 1: TDR and PDR (paper dependent replenisher) which are different in composition and in which the PDR is formulated primarily to account for use up of chemicals by processed paper and TDR to account for the other time dependent losses.

Case 2: TDR and PDR are different but the PDR is an existing replenisher used normally by itself at a higher utilization level or in a machine with low oxidative and evaporative losses, but which can then be used at a lower utilization level in combination with a suitably formulated TDR (Example 1).

Cases 1 and 2 are referred to as Dual Mode Replenishment (DMR).

Case 3: TDR and PDR1 are the same formula and are used in combination with another solution which is the PDR2 consisting of colour developing agent and a small amount of preservative; PDR2 is added only as a function of paper throughput. Although TDR and PDR1 are the same, the solution is added both on a time dependent basis and on a paper throughput dependent basis.

This case has been called Tri-Modal Replenishment (TMR).

In all these cases, the chemical loss rates can be determined by the procedure outlined above and then it is a simple calculation to estimate the composition of the TDR and PDR.

EXAMPLE 1

This example used EP-2 developer LORR in a Kreonite roller transport paper processor. This particular version of EP-2 developer LORR was designed for high utilization use in a non-roller transport deep tank machine. The utilization used in this run was 5% which is low in this machine and would not normally be recommended. It would be expected that the process activity would fall due to oxidation of colour developing agent because of loss of anti-oxidant protection under the harsh conditions of a roller transport processor. A partial solution to this problem is to increase the replenishment rate; this increase however must be quite large to maintain satisfactory levels of the main anti-oxidants, sulphate and hydroxylamine. Under these conditions the bromide level, anti-oxidant level and benzyl alcohol level would be low and sensitometry would not be on aim. To overcome these problems a second replenisher was used in addition to the normal replenisher which contained higher amounts of anti-oxidants. This is Case 2 as outlined above.

This second replenisher was added on a time dependent basis and is referred to as a TDR. The composition of the paper dependent replenisher (PDR) and TDR are shown in Table 2.

TABLE 2

| Replenisher Compositions | | |
|---|---|---|
| Component | TDR | PDR |
| TEA | 6.20 | 4.25 |
| CD3 | 2.15 | 7.10 |
| BzOH | 18.40 | 18.00 |
| $K_2SO_3$ | 4.70 | 2.37 |
| HAS | 5.10 | 4.00 |
| AC5 | 0.40 | 0.72 |
| DEG | 12.00 | 12.00 |
| pH | 10.3 | 10.55 |

A combination of two replenishers like this can cover a wider range of utilization and so can extend the useful range of an existing PDR. Ideally for this application both the TDR and PDR would be formulated to give the best control of the final tank composition over as wide a range of utilization as possible. This would be Case I as outlined above.

In the particular example shown here, the PDR was already fixed to be that for F:P-2 developer LORR and the TDR was formulated to match this.

In an attempt to predict the behaviour of the PDR at low utilization (5%) in a roller transport processor under various conditions, three computer simulation runs were carried out based on data from the ALKRE processor. The machine and process details are set out in Table 3.

TABLE 3

| Machine and Process Details | | | |
|---|---|---|---|
| | Run 1 | Run 2 | Run 3 |
| Paper replenishment rate (ml/ft$^2$) | 19 | 30 | 19 |
| Average TDR flow rate (ml/hr) | 0 | 0 | 20.33 |
| Average evaporation rate (ml/hr) | 18.86 | 18.86 | 18.86 |
| Average extra water addition | 18 | 18 | 0 |
| Developer volume (l) | 44 | 44 | 44 |
| Machine speed (in/min) | 13 | 13 | 13 |
| Machine width (in) | 20 | 20 | 20 |
| Hours per day machine is on (hr) | 8 | 8 | 8 |
| Days per week machine is on (days) | 5 | 5 | 5 |
| Utilization (%) | 5 | 5 | 5 |

Runs 1 and 2 use no TDR, and Run 3 uses a higher TDR than would normally be used. The concentrations of the solutions for each run are tabulated in respective Tables 4, 5, and 6.

In Run 1, the benzyl alcohol (BzOH), sulphite, hydroxylamine (HAS) and triethanolamine (TEA) fall to zero and CD3 is low (see Table 4).

TABLE 4

| Concentrations of Solutions - Run 1 | | | | |
|---|---|---|---|---|
| | | | DEVELOPER | |
| | TDR | PDR | Start | End |
| alkali | 0.00 | 20.35 | 22.90 | 15.20 |
| KBr | 0.00 | 0.00 | 1.12 | 1.18 |
| TEA | 0.00 | 4.25 | 2.90 | −2.39 |
| CD3 | 0.00 | 7.10 | 4.97 | 2.39 |
| BzOH | 0.00 | 18.00 | 12.60 | −2.27 |
| $K_2SO_3$ | 0.00 | 2.37 | 1.66 | −2.53 |
| HAS | 0.00 | 4.00 | 2.80 | −1.37 |
| $K_2SO_4$ | 0.00 | 8.94 | 5.94 | 9.27 |
| Phorwite REU | 0.00 | 1.00 | 0.70 | 1.04 |
| KCl | 0.00 | 0.34 | 0.24 | 0.88 |
| LiCl | 0.00 | 1.89 | 1.32 | 1.96 |
| Versa TL73 | 0.00 | 0.25 | 0.17 | 0.26 |
| AC5 | 0.00 | 0.72 | 0.50 | 0.75 |
| DTPA | 0.00 | 0.00 | 0.00 | 0.00 |
| $K_2CO_3$ | 0.00 | 22.40 | 25.20 | 23.21 |
| pH | 0.00 | 10.55 | 10.08 | 9.51 |
| DEG | 0.00 | 12.00 | 8.40 | 12.44 |

When the paper replenishment rate is increased from 19 to 30 ml/ft$^2$, as in Run 2, the CD3 is brought up to the correct seasoned level (~4.0), see Table 5, but the bromide, benzyl alcohol, sulphite and HAS levels are low.

TABLE 5

| Concentrations of Solutions - Run 2 | | | | |
|---|---|---|---|---|
| | | | DEVELOPER | |
| | TDR | PDR | Start | End |
| alkali | 0.00 | 20.35 | 22.90 | 19.76 |
| KBr | 0.00 | 0.00 | 1.12 | 0.74 |
| TEA | 0.00 | 4.25 | 2.90 | 0.10 |
| CD3 | 0.00 | 7.10 | 4.97 | 4.16 |
| BzOH | 0.00 | 18.00 | 12.60 | 5.33 |
| $K_2SO_3$ | 0.00 | 2.37 | 1.66 | −0.69 |
| HAS | 0.00 | 4.00 | 2.80 | 0.65 |
| $K_2SO_4$ | 0.00 | 8.94 | 5.94 | 9.14 |
| Phorwite REU | 0.00 | 1.00 | 0.70 | 1.02 |

TABLE 5-continued

| Concentrations of Solutions - Run 2 | | | | |
|---|---|---|---|---|
| | | | DEVELOPER | |
| | TDR | PDR | Start | End |
| KCl | 0.00 | 0.34 | 0.24 | 0.68 |
| LiCl | 0.00 | 1.89 | 1.32 | 1.93 |
| Versa TL73 | 0.00 | 0.25 | 0.17 | 0.26 |
| AC5 | 0.00 | 0.72 | 0.50 | 0.74 |
| DTPA | 0.00 | 0.00 | 0.00 | 0.00 |
| $K_2CO_3$ | 0.00 | 22.40 | 25.20 | 22.91 |
| pH | 0.00 | 10.55 | 10.08 | 9.98 |
| DEG | 0.00 | 12.00 | 8.40 | 12.27 |

Thus, simply increasing the replenishment rate does not give a satisfactory result at very low utilization and a complete reformulation would be necessary to obtain satisfactory results.

By the use of a TDR, as in Run 3, the range of use to low utilization (5%) can be extended, see Table 6.

TABLE 6

| Concentrations of Solutions - Run 3 | | | | |
|---|---|---|---|---|
| | | | DEVELOPER | |
| | TDR | PDR | Start | End |
| alkali | 12.30 | 20.35 | 22.90 | 19.72 |
| KBr | 0.00 | 0.00 | 1.12 | 1.08 |
| TEA | 6.20 | 4.25 | 2.90 | −2.39 |
| CD3 | 2.15 | 7.10 | 4.97 | 3.86 |
| BzOH | 18.40 | 18.00 | 12.60 | 12.33 |
| $K_2SO_3$ | 4.70 | 2.37 | 1.66 | 1.38 |
| HAS | 5.13 | 4.00 | 2.80 | 2.77 |
| $K_2SO_4$ | 6.73 | 8.94 | 5.94 | 13.70 |
| Phorwite REU | 0.00 | 1.00 | 0.70 | 0.94 |
| KCl | 0.00 | 0.34 | 0.24 | 0.80 |
| LiCl | 0.00 | 1.89 | 1.32 | 1.78 |
| Versa TL73 | 0.00 | 0.25 | 0.17 | 0.24 |
| AC5 | 0.40 | 0.72 | 0.50 | 0.99 |
| DTPA | 0.00 | 0.00 | 0.00 | 0.00 |
| $K_2CO_3$ | 12.50 | 22.40 | 25.20 | 30.92 |
| pH | 10.32 | 10.55 | 10.08 | 10.07 |
| DEG | 12.00 | 12.00 | 8.40 | 20.71 |

Here the TDR is formulated by the method of this invention and also so that it can be added to approximately take account of water evaporation in the processor.

Figure 4:
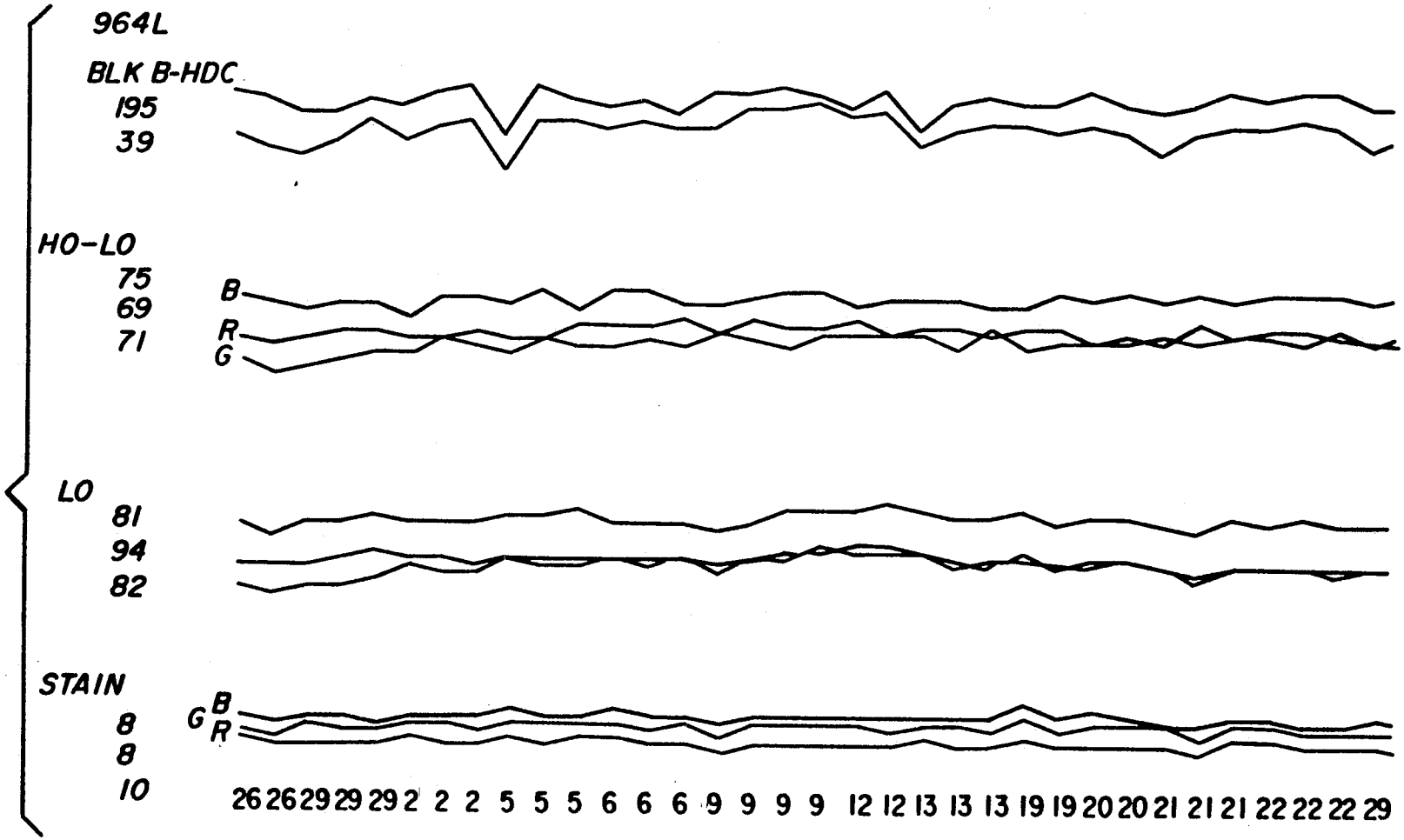
FIG. 4 is a control plot of one run showing the sensitometric effects.

Run 3 is the same as that in Table 1 and was used in a real machine seasoning run. A control plot of this seasoning run is shown in FIG. 4 which maintained consistent sensitometry throughout.

Similar runs without TDR show a fall-off in activity and ultimately exhibit process collapse as predicted by the computer simulation model.

A further example showing how the present invention can be applied in a process for 'Ektacolor' paper is described below.

EXAMPLE 2

A fresh tank of 'Ektaprint-2' LORR developer was prepared following instructions supplied with the kit.

The composition of the replenisher and time dependent replenisher prepared is shown in Table 7:

TABLE 7

| Time dependent replenisher and replenisher formulation | |
|---|---|
| Component | Amount per liter |
| Benzyl alcohol | 19.5 ml |
| Diethylene glycol | 12.0 ml |
| Triethanolomine (100%) | 5.3 g |

TABLE 7-continued

| Time dependent replenisher and replenisher formulation | |
|---|---|
| Component | Amount per liter |
| Hydroxylamine sulphate | 4.7 g |
| Potassium chloride | 3.16 g |
| Versa TL 73 | 0.28 g |
| Potassium bromide | 1.15 g |
| CD-3 | 4.35 g |
| Potassium sulphite | 3.05 g |
| Phorwite REU | 0.7 g |
| Potassium hydroxide (48%) | 8.6 g* |
| Antical 5 | 0.8 ml |
| Potassium carbonate | 22.4 g |

*adjustable to pH 10.08

A paper dependent replenisher was prepared as shown in Table 8:

TABLE 8

| Paper dependent replenisher formulation | |
|---|---|
| Component | Amount per liter |
| CD-3 | 65.0 g |
| Potassium sulphite | 2.75 g |

'Ektacolor' paper, 22% exposed to $D_{max}$, was processed in the developer and was replenished as follows:

The time dependent replenishment rate during the day was 147.5 ml/hr and at night or when the machine is off was 67.5 ml/hr. The paper dependent replenisher was added at 1 ml/ft$^2$ and the replenisher (same formulation as the time dependent replenisher) at 12.5 ml/ft$^2$.

The paper dependent replenisher was added such that it went into empty space and the replenisher and time dependent replenisher were added after the machine had been topped up with water and so always replaced tank developer.

'Ektacolor' and 'Ektaprint', referred to above, are trade marks.

It is to be noted that the present invention is not limited to use with colour developer soultions as described in the examples, but could equally well be used for black and white developer solutions.

Furthermore, the present invention could be used for any other solution where components are lost due to evaporation or oxidation.

We claim:

1. A method of replenishing photographic processing solutions, containing water and one or more components, in photographic processing apparatus in which one or more components are lost from the processing solution by oxidation or evaporation, characterized in that the replenishment rate for a particular component in a given solution is determined as a function of water evaporation rate from the apparatus.

2. A method according to claim 1, wherein the function for any given solution is determined by measuring component loss rates for that solution for different water evaporation rates.

3. A method according to claim 1 or 2, wherein the determined function for that particular component in a given solution is applicable to any processing apparatus using that given solution.

4. A method according to claim 1, wherein the water evaporation rate is proportional to the effective surface area.

5. A method according to claim 1, wherein the function is substantially linear.

6. A method according to claim 1, further including a replenishment in accordance with throughout of material being processed.

* * * * *